United States Patent [19]

Whitener

[11] 3,958,393

[45] May 25, 1976

[54] FISH PACKAGE AND MODE OF USE THEREOF

[76] Inventor: Kevin F. Whitener, 5103 Karen Blvd., Apt. 24C, Riverside, Mo. 64151

[22] Filed: July 11, 1974

[21] Appl. No.: 487,777

[52] U.S. Cl. ..... 53/37; 53/227; 53/370

[51] Int. Cl.[2] ..... B65B 3/04

[58] Field of Search ..... 53/37, 38, 128, 193, 53/227, 370, 42

[56] References Cited

UNITED STATES PATENTS 3,851,440 12/1974 Horsky ..... 53/227 X

*Primary Examiner*—Othell M. Simpson
*Assistant Examiner*—Leon Gilden
*Attorney, Agent, or Firm*—John A. Hamilton

[57] ABSTRACT

A package for transporting live fish consisting of a pliable, open-mouthed bag having an elastic band secured around its mouth and partially gathering said mouth, and the mode of use of said package consisting of filling the bag partially with water and fish, twisting the sack intermediate the water and the open mouth to form a seal, and everting the portion of the bag between its mouth and the twist around the portion thereof containing water and fish. An open, buoyant ring may be secured in the sack mouth by the elastic band to float the bag in an aquarium to acclimate the fish to the water temperature of the aquarium.

1 Claim, 7 Drawing Figures

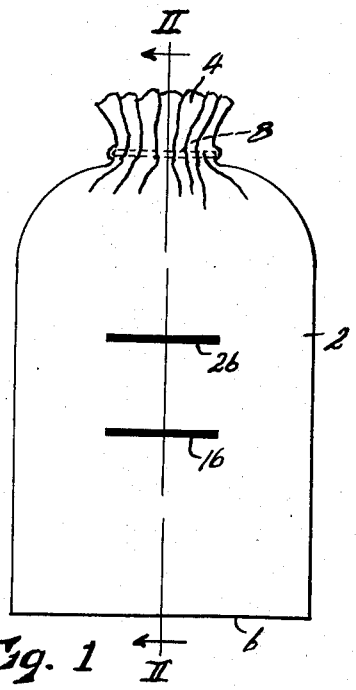
Fig. 1
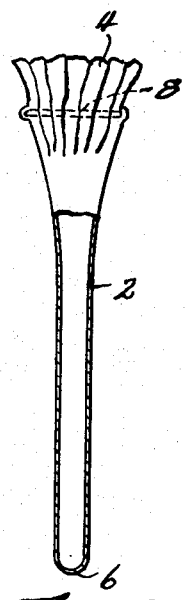
Fig. 2
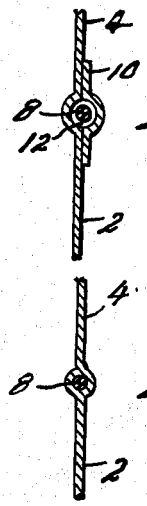
Fig. 4
Fig. 3
Fig. 5
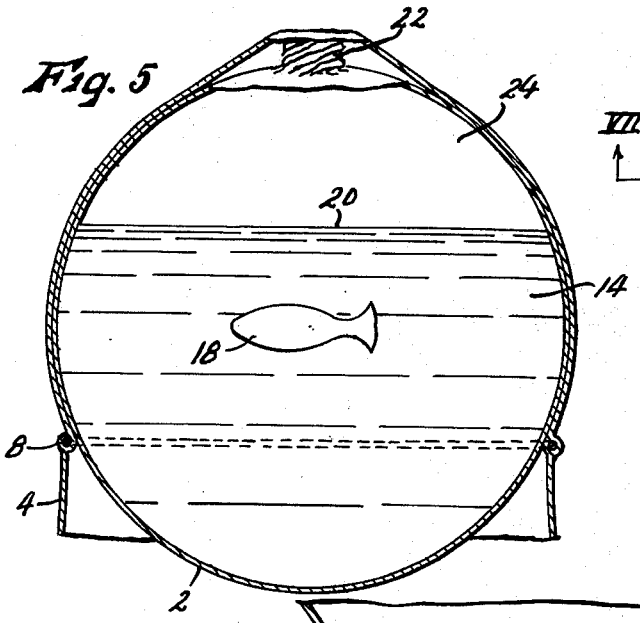
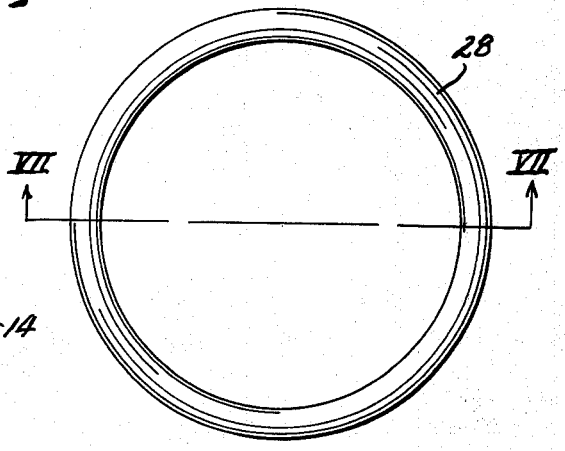
Fig. 6
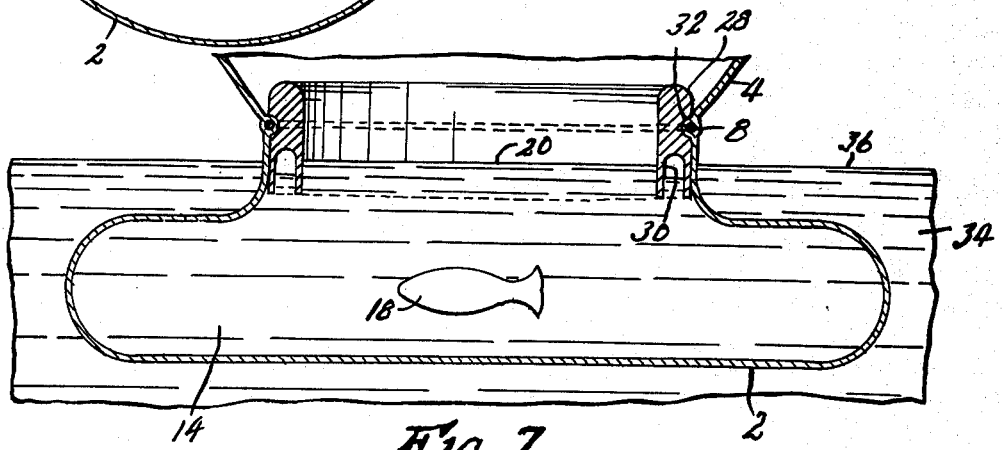
Fig. 7

FISH PACKAGE AND MODE OF USE THEREOF

This invention relates to new and useful improvements in packaging devices, and has particular reference to a package especially adapted for transporting live fish, for example from a store at which said fish is purchased to a home aquarium. Fish to be transported in this manner are commonly sealed in plastic or otherwise waterproof bags, together of course with sufficient water and air to sustain the fish for an ample time period to allow transportation to an aquarium or other permanent quarters. However, a common problem experienced with containers of this type has been provision of a rapid, simple, economical and efficient means for closing the bag mouth against leakage and loss of water through its mouth as the bag is carried and handled, possibly rather roughly, during transportation thereof. Such closure means have often been rather intricate, complicated and expensive.

Accordingly, the principal object of the present invention is the provision of a structure and method whereby the mouth of the bag may be sealed efficiently, rapidly and easily, but which nevertheless is extremely simple and economical.

Another consideration affecting fish transporting packages is that generally the fish, which is subjected to varying ambient temperatures, possibly over a rather wide range, as they are transported in the package, should be acclimated gradually to the water temperature of the aquarium, since sudden changes of water temperature can be harmful or even fatal to many delicate fish. This acclimatization can be accomplished by simply immersing the package in the aquarium, so that the package water assumes the temperature of the aquarium water only gradually, before removing the fish from the package to the aquarium water. During this process, the water surface of the package should be exposed to the atmosphere to insure adequate air supply to the fish, but the package and aquarium water should not be allowed to intermix. Another object of the present invention, therefore, is the provision of an open, buoyant ring adapted to be connected into the mouth of the open bag or sack to hold said mouth open as it is inserted into an aquarium, whereby to admit air thereto, the buoyancy of the ring holding the bag mouth above water level to prevent intermixture of the bag water with the aquarium water, and the ring forming a convenient "handle" for manipulating the bag to remove the fish therefrom.

Other objects are simplicity and economy of construction, efficiency and dependability of operation, and adaptability for usages other than the transportation of fish.

With these objects in view, as well as other objects which will appear in the course of the specification, reference will be had to the accompanying drawing, wherein:

FIG. 1 is a side elevational view of a fish package embodying the present invention, shown unloaded and open, FIG. 2 is a sectional view taken on line II—II of FIG. 1, with parts left in elevation, FIG. 3 is an enlarged fragmentary sectional view of a wall of the bag at the mouth thereof, FIG. 4 is a view similar to FIG. 3, but showing a modified construction, FIG. 5 is an enlarged sectional view similar to FIG. 2, but showing the bag loaded and closed, FIG. 6 is a face view of an auxiliary ring for use in connection with the bag, and FIG. 7 is a sectional view taken on line VII—VII of FIG. 6, showing the ring in operative relationship to a bag deposited in an aquarium.

Like reference numerals apply to similar parts throughout the several views, and the numeral 2 applies to a bag formed of a thin, pliable material, such as plastic film. Said bag may have different configurations, except that it is generally tubular, having an open mouth portion 4 at one end, and is closed at its opposite end as at 6. The bag is completely waterproof except for the open mouth thereof.

Completely encircling the bag adjacent the mouth thereof is an endless band 8 of elastic material such as rubber. Said band is connected generally continuously to the bag wall in any suitable manner, for example by molding it into the bag wall material as indicated in FIG. 3 if the bag is formed of moldable material, or by cementing or adhering a strip 10 of material similar to that of which the bag is formed to the external surface of the bag to form an endless tubular tunnel 12 in which the band is enclosed, as indicated in FIG. 4. Also, the band itself could be cemented or otherwise adhered to the bag wall, either continuously or at intervals around its periphery. The band is of such circumference that when relaxed, it gathers the bag mouth to a partially but not completely closed position, as shown in FIGS. 1 and 2, but can be stretched resiliently to a length generally equalling the circumference of the body portion of the bag below its mouth. It is not practically possible to use an elastic band in the manner shown which would contract to a sufficiently small diameter to close the bag mouth in a water-tight seal, and which would still be expandable to permit full opening of the bag mouth.

In the use of the bag as thus far described, the bas is held by its neck portion, say approximately at elastic band 8, and while holding its mouth sufficiently open by any suitable means, filling it partially with water 14. It will appear that for best results the level to which the bag is filled with water is somewhat critical. This level may be carefully determined and indicated by a line 16 imprinted on the bag by the manufacturer, which may be termed the "fill" line. This line will be spaced from the closed bottom 6 of the bag by a distance less than one-half of the distance from the bottom edge 6 to elastic band 8. One or more fish 18 may then be placed in the water 14 in the bag. The bag is then twisted tightly at a point above the water level 20 therein, the twist being indicated at 22 in FIG. 5, to form a water-tight seal, trapping a quantity of air 24 in the bag above the water level which is sufficient to supply oxygen to the fish for a substantial time period during transportation thereof. As will appear, the point at which twist 22 is formed is also somewhat critical, and may be indicated by a second line 26 imprinted on the bag by the manufacturer, which may be termed the "twist" line, and which should be spaced apart from elastic band 8 by a distance more than one-half of the distance from said line to the bottom edge 6 of the bag. Preferably, the twist is made after first gathering the bag in a tightly closed condition in the region of elastic band 8, in the fingers of one hand, and sliding the fingers downwardly to twist line 26. This compresses the air 24 in the bag to some degree, and causes the portion of the bag filled with water and compressed air to assume a generally globular shape, also as indicated in FIG. 5. Finally while keeping twist 22 tight, the portion of the bag between twist line 26 and elastic band 8 is everted or turned inside out around the generally globular portion thereof, so that the parts have the relative positions shown in FIG. 5. In this position, it will be seen that elastic band 8 has passed beyond the thickest portion of the water-containing portion of the bag and has partially retracted, but is nevertheless still extended substantially from its relaxed length, and is still under considerable tension. Thus it holds the bag parts firmly in the relative positions shown preventing loosening of twist 22 thereof and hence preserving a satisfactorily water-tight seal, and the package is complete. It may be safely carried in any position with no danger of leakage. The bag material is preferably transparent, to permit observation of the fish contained therein, but may be tinted if desired to prevent possible exposure of the fish to direct sunlight.

FIGS. 6 and 7 show an auxiliary device useful in connection with the bag thus far described. Said device constitutes an open, rigid ring 28 of lightweight, buoyant structure having an outer circumference no greater, and preferably somewhat less, than the circumference of the bag itself. It may be rendered buoyant by forming it of buoyant material such as wood or cork, or by the use of non-buoyant material if formed with a hollow cross-sectional contour, or, as shown, by forming it of a non-buoyant material but with a deep, peripheral groove 30 formed in its lower face. When this ring it laid in water with its grooved face down, air trapped in the groove renders the ring buoyant. A peripheral groove 32 is formed in the outer peripheral surface of the ring.

In use, ring 28 is inserted into the bag mouth 4 after expanding elastic band 8, and secured therein by the contraction of band 8 into groove 32, as shown in FIG. 7. It may conveniently be used as an aid for holding the bag mouth open while inserting water and fish therethrough, but it is intended primarily for use in acclimating the fish to an aquarium. As has been previously discussed, if the fish is moved abruptly from the package, in which the water is at one temperature, to an aquarium in which the water is at a widely different temperature, the sudden water temperature change may be extremely harmful to the fish. It is therefore desirable that the package water temperature be slowly and gradually equalized with the aquarium water temperature before the fish is removed from the package and placed in the aquarium. This equalization of temperature could be accomplished simply by immersing the closed and sealed package of FIG. 5 in the aquarium water indicated at 34 in FIG. 7 for a time period long enough to permit equalization to occur, before opening the package and dumping the fish into the aquarium water. However, the time period required may in some cases be relatively long, or the owner may inadvertly forget to open the package when permissable, with the result that the available oxygen of the air trapped in the package is consumed, and the fish are damaged or die from lack of oxygen. To prevent this occurrence, the package is immediately opened and ring 28 inserted in its mouth as described, and the bag lowered into the aquarium water until ring 28 floats, as shown in FIG. 7. The water level in the bag of course will be coplanar with the water level 36 of the aquarium, while the bag itself will assume some indeterminate shape in the aquarium water, being held open and uncollapsed by the water 14 therein. The bag water level 20 is of course fully exposed to the atmosphere, whereby to insure an ample air supply for the fish, while ring 28 holds mouth 4 of the bag above water level to insure that there will be no intermixture of the bag and aquarium waters, such intermixture being undesirable since it would speed up and interfere with the desired temperature equalization by rendering it too fast. After the temperature equalization is complete, the acid-alkaline content of the bag water may be gradually balanced with that of the aquarium by dipping quantities of the aquarium water into the bag through ring 28 at spaced apart time intervals. If, for example, the bag water is highly acid and the aquarium water is alkaline, abrupt transferral of the fish to the aquarium may induce a state of shock very harmful to the fish. Then the bag may simply be inverted to dump the fish, and the water then contained in the bag, into the aquarium. Ring 28 also serves as a convenient handle facilitating this step. Both the bag 2 and ring 28 may be reused if desired. Reusability of ring 28 is particularly desirable, since it may represent a substantial factor in the overall cost of the total package.

While I have shown and described a specific embodiment of my invention, it will be readily apparent that many minor changes of structure and operation could be made without departing from the spirit of my invention.

What I claim as new and desire to protect by Letters Patent is:

1. A method of closing a pliable bag having an open mouth and an endless elastic band secured peripherally thereto adjacent said mouth and normally restricting the diameter of said mouth, with a water-tight seal, said method consisting of the successive steps, partially filling the bag with water wherein said bag is filled to a depth less than one-half of the distance from said elastic band to the closed end thereof, a. twisting the bag tightly to form a water-tight seal at a point above the water level thereof but below said elastic band wherein said twisting is performed at a point of the bag closer to said elastic band than the water level therein, but spaced from said elastic band by a distance greater than one-half the distance from said twist to the closed end of said bag, and b. everting the portion of said bag intermediate said twist and said elastic band about the portion of said bag containing water, whereby said elastic band is resiliently extended and grips the filled bag portion to secure said twist against loosening whereby said elastic band grips the filled portion of said bag at a point thereof which is reducing in diameter away from said twist.

* * * * *